US006125761A

United States Patent [19]

Smith, Jr. et al.

[11] Patent Number: 6,125,761

[45] Date of Patent: Oct. 3, 2000

[54] ZINC OXIDE INHIBITED EMULSION EXPLOSIVES AND METHOD

[75] Inventors: Robert G. Smith, Jr., Tucson; Harry R. Fee, Green Valley, both of Ariz.

[73] Assignee: Southwest Energy Inc., Tucson, Ariz.

[21] Appl. No.: 08/908,654

[22] Filed: Aug. 7, 1997

[51] Int. Cl.[7] ..... F42B 3/00

[52] U.S. Cl. ..... 102/313; 102/312; 86/20.15

[58] Field of Search ..... 102/312, 313; 86/20.15

[56] References Cited

U.S. PATENT DOCUMENTS

| | | | |
|---|---|---|---|
| 3,447,978 | 6/1969 | Bluhm | 149/2 |
| 3,447,982 | 6/1969 | Minnick | 149/46 |
| 3,640,784 | 2/1972 | Yancik et al. | 149/43 |
| 3,645,810 | 2/1972 | Genden | 149/43 |
| 3,708,356 | 1/1973 | Masea et al. | 149/2 |
| 3,798,091 | 3/1974 | Knight, Jr. | 149/60 |
| 4,008,108 | 2/1977 | Chrisp | 149/2 |
| 4,058,420 | 11/1977 | Barnhard, IV et al. | 149/41 |
| 4,081,299 | 3/1978 | Griffith | 149/43 X |
| 4,138,281 | 2/1979 | Olney et al. | 149/2 |
| 4,547,232 | 10/1985 | Cartwright | 149/2 |
| 4,756,779 | 7/1988 | Matts | 102/313 X |
| 4,919,178 | 4/1990 | Riga et al. | 149/2 |
| 5,026,442 | 6/1991 | Yabsley et al. | 149/2 |
| 5,129,972 | 7/1992 | Riga et al. | 149/2 |
| 5,159,153 | 10/1992 | Cranney et al. | 102/313 |
| 5,192,819 | 3/1993 | Baumgartner | 102/313 X |

OTHER PUBLICATIONS

"Reactivity of ANFO With Pyrite Containing Weathering Products—Evaluation of Additional Inhibitor" by Yael Miron, Thomas C. Ruhe and J. Edmund Hay, Bureau of Mines Report of Investigations/1982, RI8727, pp. 1–13.

"The Reactivity of Ammonium Nitrate–Fuel Oil With Pyrite–Bearing Ores" by D. R. Forshey, T. C. Ruhe and C. M. Mason, Bureau of Mines Report of Investigations 7187, pp. 1–10.

Reactivity of AN–FO with Pyrite Containing Weathering Products by Yael Miron, Thomas C. Ruhe and Richard W. Watson, Bureau of Mines Report of Investigations/1979, RI8373, pp. 1–24.

"Rational Selection of Inhibitors of Thermal Decomposition of Ammonium Nitrate" by B. Yu. Rozman, Journal of Applied Chemistry of the USSR, vol. 33, No. 6, pp. 1258–1263, Jun., 1960.

"Inhibition of the Thermal Decomposition of Ammonium Nitrate" by B. Yu. Rozman and L. I. Borodkina, Journal of Applied Chemistry of the USSR, vol. 32, No. 2, pp. 291–294, Feb. 1959.

*Primary Examiner*—Peter A. Nelson

*Attorney, Agent, or Firm*—Cahill, Sutton & Thomas P.L.C.

[57] ABSTRACT

A method of blasting in reactive ores includes diluting hot liquor of ammonium nitrate with water to provide diluted ammonium nitrate solution of predetermined concentration, adjusting the pH of the liquor of the ammonium nitrate solution, adding a predetermined amount of gassing agent to the ammonium nitrate solution, and emulsifying the ammonium nitrate solution. Then an effective amount of fine zinc oxide powder is mixed with the emulsion explosive and the inhibited emulsion explosive is introduced into a borehole and detonated.

15 Claims, 3 Drawing Sheets

ZINC OXIDE INHIBITED EMULSION EXPLOSIVES AND METHOD

BACKGROUND OF THE INVENTION

The invention relates to inhibited emulsion explosives, and more particularly to zinc oxide inhibited emulsion explosives.

U.S. Pat. No. 5,159,153 (Cranney et al.), incorporated herein by reference, acknowledged the well known problem that certain sulfide/pyrite ores are reactive with ammonium nitrate, and that when a blasting agent containing ammonium nitrate is used in a borehole, heat generated in the borehole by such reactivity can cause premature detonations. The Cranney et al. patent refers to U.S. Bureau of Mines Reports of Investigation Nos. 7187 (hereinafter, "Report 7187") and 8373 (hereinafter, "Report 8373") and U.S. Pat. Nos. 3,447,982 and 3,708,356 as disclosing use of urea to inhibit any reaction of AN (ammonium nitrate) or ANFO (ammonium nitrate and fuel oil) with reactive ores.

Cranney et al. specifically teach that the oxidizer salt ammonium nitrate, urea and other aqueous soluble constituents are preferably first dissolved in the water or an aqueous solution of water and miscible liquid fuel.

Report 7187 (1968) disclosed that the addition of 5 percent acid to ANFO reduced the reaction temperature from 340° to 228° F. The temperature of incipient reaction of mixtures of AN and pyritic ore was similar to that of mixtures of ANFO and ore, both dry and with water or acid, except that the reactions of the oil-free mixtures were more exothermic. Report 7187 also disclosed that mixtures of "AN-ore" and "AN-FO ore" with 0.5 and 1.0% urea, both dry and with 5 percent water elevated the reaction temperature from 185° F. to 350° F. Referring to a study by Rozman "On the Rational Behavior of Inhibitors on the Thermal Decomposition of Ammonium Nitrate", J. Appl. Chem., U.S.S.R., June 1960, pp. 1258–1263 of thermal decomposition of AN by Rozman, Report 7187 disclosed that the addition of urea, zinc oxide, or other basic salts to the AN-sulfur-potassium chloride mixture stabilized the exothermic reaction to about 550° F., probably due to inhibition of acid-catalyzed exothermic reactions. Thus, Report 7187 disclosed that urea effectively inhibits reactivity of ammonium nitrate prills (AN), ammonium nitrate in ANFO, and ammonium nitrate in aqueous solution.

Report 8373 (1979) discloses that 5 percent by weight of urea was found sufficient to prevent a reaction among ammonium nitrate, fuel oil, and ferrous sulfate, which is a product of weathering of certain sulfides and pyrites. Smaller amounts of the urea and potassium oxalate slowed down the reaction and delayed its onset to higher temperatures, but did not prevent it. Report 8373 also discloses the main chemical reaction that needs to be inhibited. The Bureau of Mines Reports 7187 and 8373, and the two Rozman articles cited therein disclose that the reaction occurs in the presence of pyrite ore including ferrous sulfate and ammonium nitrate in any form, irrespective of whether the ammonium nitrate is solid, is wetted by 6% fuel oil (as in ANFO), or is in aqueous solution (as in emulsion explosives).

According to Report 8373, five weight percent urea completely prevented an exothermic reaction among the ingredients when the test mixture was heated up to 180° C., and indicated that (1) urea inhibits reaction between AN-FO and ferrous sulfate by combining with one or more of the ingredients in the original reaction mixture, (2) only when enough urea is present is reaction prevented, (3) urea can undergo many reactions, and replaces water of crystallization in many salts, including sulfates, thereby forming new compounds with different stabilities than the original salts, and (4) urea also forms adducts with paraffin hydrocarbons (such as fuel oil).

Thus, it was well known that urea is effective in inhibiting the reaction of the nitrate radical $NO_3^-$ with the ferrous ion $Fe^{++}$ to generate heat, which then can lead to autocatalytic exothermic decomposition of ammonium nitrate and cause premature detonation. It also was known that regardless of whether the ammonium nitrate is dry, wetted with fuel oil, or in aqueous solution, the nitrate radical $NO_3^-$ therein is available to react with certain sulfides and the ferrous ion.

A third Bureau of Mines Report No. 8727 (hereinafter, "Report 8727") published in 1982 discloses that (1) urea also combines with acids, but (2) in the opinion of the authors of Report 8727 it is urea's ability to undergo additional reactions that makes it the best inhibitor of the ones tested. If urea is added as a dry prilled ingredient at sufficient levels to be effective as an inhibitor in emulsion explosives, i.e., approximately 3 to 5 weight percent, then the hygroscopic nature of urea causes handling problems. Storage space and weight limitations become problematic, particularly with mobile manufacturing equipment used at borehole sites. Another drawback to adding prilled urea as a dry ingredient in emulsion explosives is the fact that at economical levels, solid urea is not well dispersed therein and a relatively large amount of the urea is not in contact with the emulsion or the pyrite ore. Consequently, an undesirably large portion of the emulsion explosive is not stabilized and there may continue to be a significant risk of a premature detonation. Even though urea prills could be ground up to provide small particle sizes which would be more uniformly dispersed in the emulsion explosive, the extremely hygroscopic nature of the urea particles would make storage thereof very problematic. Grinding urea prills at the time of manufacture is not practical on a mobile manufacturing unit at the borehole site.

It would be desirable to provide an economical inhibited emulsion explosive which avoids the above drawbacks of urea-inhibited emulsion explosives, namely the increase in pH, the storage and handling problems, and the poor dispersal of urea prills in the oxidizer phase.

To summarize the teachings of the known prior art, the earliest Bureau of Mines report concluded that the Butte, Mont. accident on May 16, 1967 could have been prevented by introducing powdered zinc oxide as a coating when mixing prilled ammonium nitrate and fuel oil prior to ejector placement of the coated ANFO into three inch diameter blast holes at the accident site. However, the later Bureau of Mines studies focused on larger diameter vertical boreholes and bulk loaded ANFO. (Note that the Bureau of Mines reports span a period of fourteen years.) Such later studies concluded that urea was a better inhibitor of reaction between ANFO and pyritic ores than zinc oxide because urea was significantly more effective inhibiting the reaction between ANFO and ferrous sulfate, which is usually present in pyrite ore because ferrous sulfate is a weathering product of pyrite ore (iron sulfide). The Rozman articles discussed use of both zinc oxide and urea to inhibit reactivity of ammonium nitrate in aqueous solutions and concluded that urea was preferable because it is soluble in water and therefore completely dispersed in the solution. It is known that zinc oxide is very insoluble in aqueous solution, and that any attempts to use zinc oxide as an inhibitor in an aqueous solution of ammonium nitrate would require complicated and expensive efforts to keep the fine zinc oxide powder in suspension prior to passing the mixture through a high shear emulsifier.

SUMMARY OF THE INVENTION

Accordingly, it is an object of the invention to provide an inhibited emulsion explosive and method which avoids the shortcomings of urea inhibited emulsion explosives.

It is another object of the invention to avoid health and safety problems and material storage and handling problems attendant to the manufacture and use of urea inhibited emulsion explosives.

It is another object of the invention to provide an inhibited emulsion explosive which requires a smaller volume of inhibiting agent than is required if urea is used as the inhibiting agent.

It is another object of the invention to provide an inhibited emulsion explosive which avoids a problem of increasing pH which has been found to result from using urea in the discontinuous ammonium nitrate solution phase described in U.S. Pat. No. 5,159,153 by Cranney et al.

It is another object of the invention to provide an inhibited emulsion explosive for use in on-site mobile unit manufacturing equipment, which inhibited emulsion explosive avoids the problem of increasing pH that has been found to result from using urea in the discontinuous ammonium nitrate solution phase described in U.S. Pat. No. 5,159,153 by Cranney et al.

It is another object of the invention to provide an inhibited emulsion explosive and method which requires much less inhibitor storage capacity on a mobile unit than is necessary if urea is to be used as the inhibitor.

Briefly described, and in accordance with one embodiment thereof, the invention provides a technique for blasting in reactive ores containing sulfides and/or pyrites by loading a borehole with an emulsion explosive including (1) an emulsifier, a continuous organic fuel phase, (2) a discontinuous oxidizer salt solution phase including water and organic oxidizer salt, and (3) solid phase zinc oxide in an amount of from about 0.25% to 10% or more by weight of the composition and then detonating the emulsion explosive. In the described embodiment commercially available hot liquor of ammonium nitrate is diluted with water to provide diluted ammonium nitrate solution of predetermined concentration. The pH of the liquor of the ammonium nitrate solution is adjusted, for example by adding soda ash, and a predetermined amount of gassing agent is added to the ammonium nitrate solution. The ammonium nitrate solution then is emulsified and an amount of fine zinc oxide powder in the range of about 0.25 to 10 weight percent is mixed with the resulting emulsion explosive to form an inhibited emulsion explosive. The inhibited emulsion explosive is introduced into a borehole and then is detonated.

DETAILED DESCRIPTION OF THE PREFERRED EMBODIMENTS

We have found that urea has several shortcomings in applications as an inhibitor in emulsion explosives. The ammonium nitrate solutions disclosed in the Cranney et al. patent conventionally are stored at 160 to 170 degrees Fahrenheit in order to ensure that crystallization does not occur when the emulsions are being formulated. We have found that under these conditions, when effective amounts of urea are employed and dissolved in the oxidizer phase, the pH of the ammonium nitrate solution is driven upward. Where the urea is dissolved in the oxidizer phase, the use of urea in the ammonium nitrate solution causes the pH to rise to about 5.8 as the storage time increases. The increased pH greatly inhibits the gassing reaction between sodium nitrite and ammonium nitrate to produce gas bubbles used to sensitize certain emulsion explosives. It has been proposed that thiourea be used to accelerate that gassing reaction to overcome the increased pH, but thiourea is a known carcinogen and as such, presents an unacceptable risk to those who would formulate and use such emulsion explosive. The high pH problem could be overcome by continuously adding acid in the storage tank, but again this would result in material handling problems.

Figure 1:
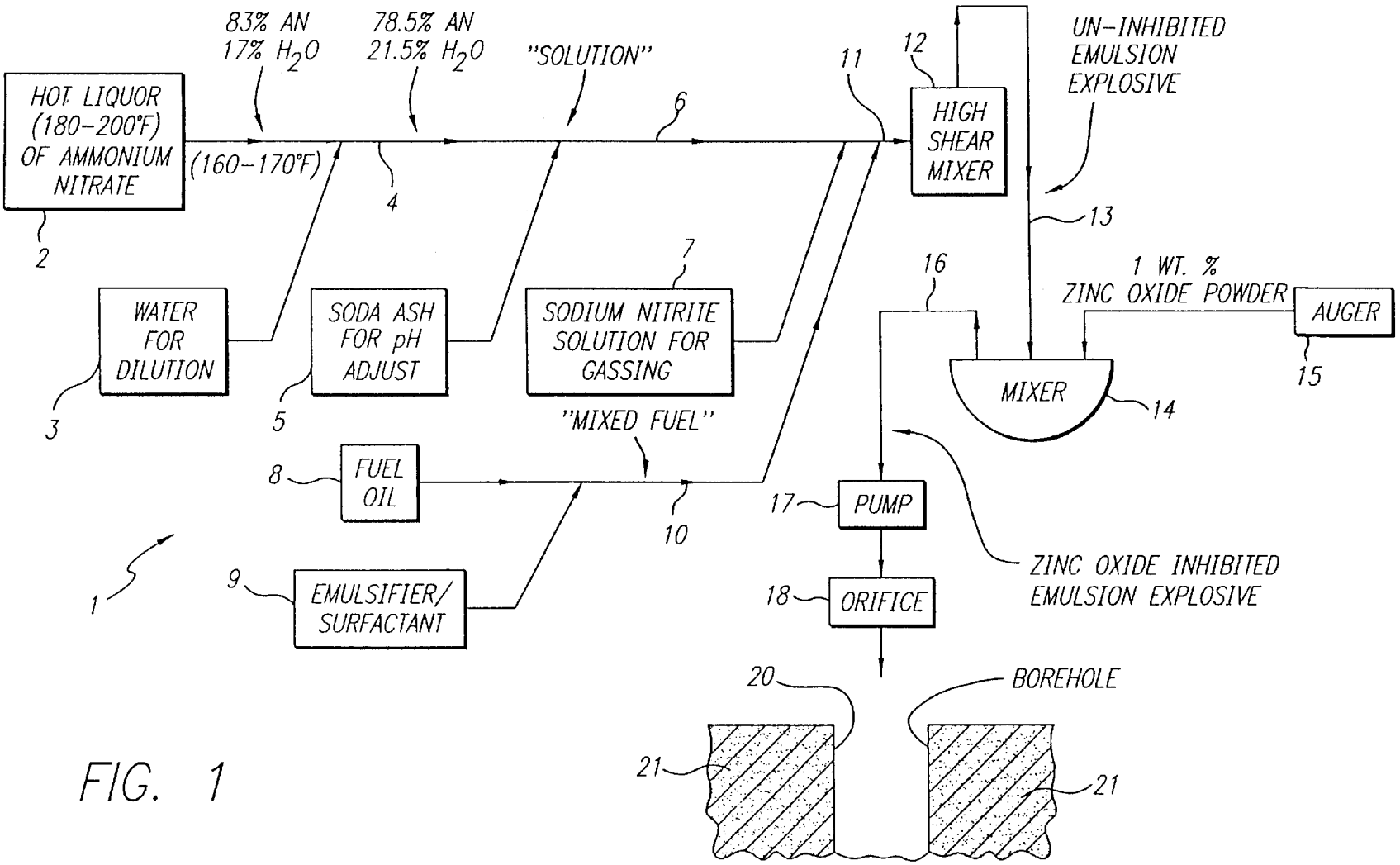
FIG. 1 is a flow diagram illustrating a first embodiment of the invention.

FIG. 1 generally illustrates a system 1 for manufacturing zinc oxide inhibited emulsion explosives according to the present invention at the site of a borehole 20 formed in reactive ore 21. Commercially available hot liquor of ammonium nitrate indicated in block 2 usually arrives at a temperature of 180 to 200 degrees Fahrenheit in a tanker truck. The hot liquor of ammonium nitrate, which typically is diluted and stored at 160 to 170° F. to ensure that crystallization does not occur, usually is pumped through a conduit including sections 4 and 6 into a suitable holding tank on an "emulsion truck" (not shown). The composition of commercially available hot liquor of ammonium nitrate typically is 83 percent ammonium nitrate and 17 percent water. As indicated in block 3, additional water also is pumped through the conduit sections 4 and 6 into the holding tank on the emulsion truck to dilute the solution in the holding tank to 78.5 percent ammonium nitrate and 21.5 percent water, to maintain the temperature of the hot liquor at the above indicated 160 to 170° F. level. As indicated in block 5, soda ash also is added to the mixture pumped into the holding tank to adjust the pH to a value in the range of 4.8 to 5.2. (Usually only a small amount of soda ash is required, for example a cup or two for a large holding tank of roughly 9500 gallons.) The pH-adjusted solution is what is actually pumped into the holding tank on the emulsion truck. Note that the pH level is quite critical for producing the emulsion explosive product which subsequently is pumped directly into borehole 20 in FIG. 1.

An aqueous solution of sodium nitrite gassing agent (block 7 in FIG. 1) is pumped into a second tank on the emulsion truck. Later, at the borehole site, the sodium nitrite solution is pumped at a carefully controlled rate into and mixed with a stream of the ammonium nitrate solution as it flows to the inlet of a high shear mixer 12 on the emulsion truck.

As indicated in block 8 of FIG. 1, ordinary fuel oil (FO), such as diesel fuel, is mixed with an emulsifier or surfactant as indicated in block 9. Various surfactants, such as sorbitan sesquioleate or sorbitan monoleate, can be used, in an amount of from about 0.5 to about 5 weight percent. The fuel oil and surfactant are mixed in the desired ratio to provide "mixed fuel" 10 which is pumped into a third tank on the emulsion truck. At the borehole site the mixed fuel 10 is pumped in a precisely controlled manner to mix it with the ammonium nitrate solution and the sodium nitrite solution to introduce the mixture of ammonium nitrate solution, sodium nitrite solution, and mixed fuel oil and emulsifier solution into an inlet of high shear mixer 12 on the emulsion truck. (High shear mixer 12 includes a series of high speed rotary blades. Other techniques also are used in commercially available mixer units or homogenizers, the latter involving use of low shear mixers to form a "pre-emulsion" material and force it at great pressure through restrictive apertures. High shear mixer 12 can be any of a variety of proprietary or commercially available devices which produce an emulsion of ammonium nitrate solution droplets in the range of 0.1 to 5 microns in diameter as a discontinuous phase with fuel oil as the continuous phase. See the reference "Emulsion Explosives" by Wang Xuguang, published by Metallurgical Industry Press, Beijing, China, 1994, English translation, incorporated herein by reference. Also see U.S. Pat. No. 4,008,108 (Chrisp) entitled "Formation of Foamed Emulsion-Type Blasting Agents" issued Feb. 15, 1977 and U.S. Pat. No. 4,138,281 (Oluey et al.) entitled "Production of Explosive Emulsion" issued Feb. 6, 1979, both incorporated herein by reference.)

The resulting un-inhibited emulsion explosive 13 is pumped into a mixer bowl 14 on the emulsion truck having an impeller mixing element therein. 1 weight percent zinc oxide powder of diameter less than 325 Mesh (i.e., less than 45 micrometers) then is conveyed into the uninhibited or neat emulsion explosive by an auger 15 or other suitable delivery mechanism into mixer bowl 14, wherein the zinc oxide powder is uniformly dispersed within the emulsion explosive. The mean particle size of the zinc oxide powder is 0.21 micrometers. The zinc oxide inhibited emulsion explosive is pumped (as indicated by numeral 16) by a suitable pump 17 through an orifice assembly 18 designed to maintain a suitable pumping pressure. The zinc oxide inhibited emulsion explosive emerging from the orifice assembly 18 is directed into borehole 20.

The amount of sodium nitrite solution 7 is varied to adjust the density of the inhibited emulsion explosive product that is pumped into borehole 20 by capturing samples thereof and determining the density. If the density is too high, the amount of sodium nitrite flow into the mixture 11 is increased accordingly. (The gas bubbles form a nucleus around which a detonation can occur in a manner similar to the detonation of a charge in a cylinder of a diesel engine, in the sense that as a detonation front progresses in the borehole, the wavefront compresses the bubbles, causing them to generate enough heat to cause or greatly aid in propagation of the detonation of the charge in the borehole.)

Figure 2:
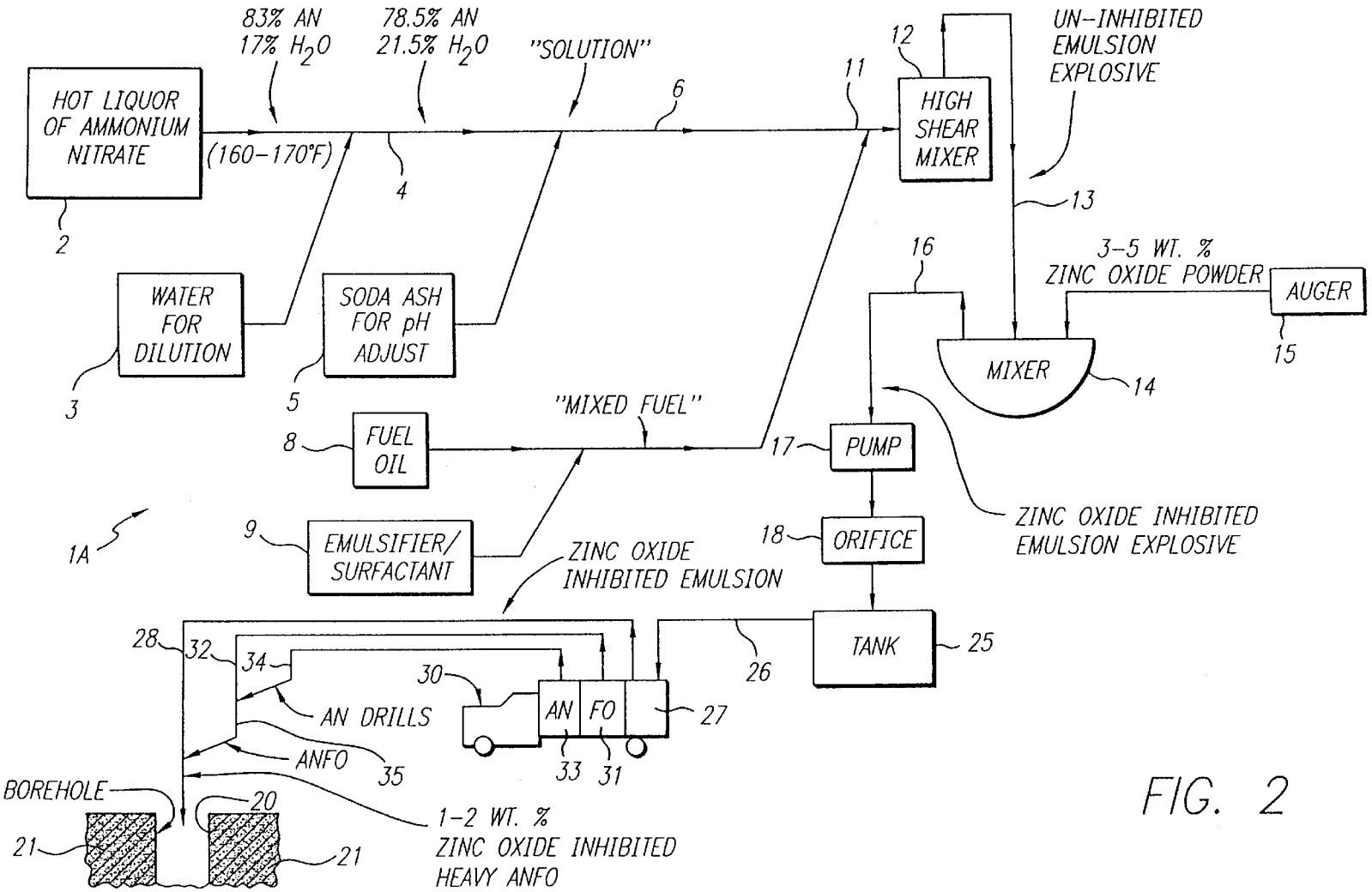
FIG. 2 is a flow diagram illustrating a second embodiment of the invention.

FIG. 2 shows a system 1A for making zinc oxide inhibited "heavy ANFO" in accordance with the invention. The system of FIG. 2 differs from the one of FIG. 1 mainly in that the pH level is not critical, and the amount of zinc oxide powder introduced into mixer bowl 14 by auger 15 is enough to constitute 1.5 to 15 weight percent of zinc oxide, and the output of pump 17 passing through orifice assembly 18 goes into a holding tank 25, rather than directly into the borehole. Then, the zinc oxide inhibited emulsion is pumped as indicated by path 26 into a first tank on a "heavy ANFO truck" 30 also including a second tank 27 of fuel oil (or any other suitable hydrocarbon fuel) and a third tank 33 of prilled ammonium nitrate. Heavy ANFO truck 30 is driven to the site of the borehole 20, and the zinc oxide inhibited emulsion explosive is pumped from tank 27 through path 28 as indicated. Meanwhile, fuel oil is metered from container 31 as indicated by path 32 and sprayed on ammonium nitrate prills moving through path 34 to provide ordinary ANFO as indicated by numeral 35. The ANFO 35 and the zinc oxide inhibited emulsion explosive 28 are combined and directed into the borehole 20. The range of the composition of heavy ANFO is from (1) 90% ANFO (which is 84% ammonium nitrate prills and 6% fuel oil) and 10% emulsion explosive, to (2) 50% ANFO (47% ammonium nitrate prills and 3% fuel oil) and 50% emulsion explosive. (The capacity of the "heavy ANFO" truck 30 to carry emulsion explosives is limited, and it is noted that products including smaller percentages of solid ammonium nitrate also could be made on the emulsion truck.)

To test the zinc oxide inhibited ammonium nitrate manufactured using the process and apparatus indicated in FIG. 1, a first sample of pyrite reactive ore and a quantity of emulsion explosive material produced by high shear mixing were given to an independent testing organization. Zinc oxide powder of diameter less than 325 Mesh and prilled urea also were supplied to the test organization. Several well-known testing techniques, including the Henkin-McGill time-to-explosion test and a "cook-off test" were performed.

Those skilled in the art understand that as the temperature of emulsion explosive material is gradually increased it reaches a "runaway point" or "critical temperature" at which it is clear that the material has become self-heating due to a reaction between the ammonium nitrate and the reactive ore. This is evidenced by a sudden increase or "spike" in a plot of temperature of the emulsion explosive material versus time. In the Henkin-McGill time-to-explosion test the emulsion explosive being tested is sealed into a small metal shell which then is placed in a block of metal that is heated by electrical heating elements to maintain a constant temperature. The time at which the metal shell explodes is used to determine the minimum thermal runaway temperature or critical temperature which gives valuable information about the thermal stability of the test material and can be used to directly compare the thermal stabilities of various explosives or samples of the same size.

The above mentioned independent tests were performed on (1) the pure or "neat" emulsion explosive material mixed with 10 weight percent ground up pyrite ore from the first sample, and also (2) samples of the emulsion explosive with 10 weight percent of reactive ore and emulsion explosive mixed with 1 percent zinc oxide 325 Mesh powder, 5 percent zinc oxide 325 Mesh powder, and 5 percent urea, respectively. The urea was supplied in the form of prills which were used in that form in the larger volume test samples, and ground up for use in the tests using small volume samples.

The overall test program included several heating tests of samples of different sizes to evaluate the "critical temperatures". The test procedures followed by the independent test organization for the neat emulsion explosive and the emulsion explosive with 1 percent zinc oxide, 5 percent zinc oxide, and 5 percent urea additives, respectively, were generally in accordance with those described by Olson and Banks in "Techniques for Analyzing Cook-Off Response", presented at the ADPA International Symposium on Energetic Materials Technology, 1994 and further described in "Applications of the Henkin Test" by Olson and Block-Bolton, presented at the ADPA International Symposium on Energetic Materials Technology, Phoenix, Ariz., pp. 24–27, September 1995. Those procedures were applied to the tests of emulsion explosive mixed with the above indicated amounts of reactive ore and inhibited by 1 weight percent zinc oxide and 5 weight percent zinc oxide, respectively, and comparison thereof with the same emulsion explosives and reactive ore inhibited by 5 weight percent urea.

The Henkin critical temperature measurements were made using 40 milligram samples. 50 gram samples were used in small cook-off bomb test procedures. Cook-off tests also were run in heated 1 liter stainless steel pressure vessels.

The results of the Henkin-McGill time-to-explosion tests are set forth below in Table 1.

TABLE 1

| Sample | Critical Temp., ° C. |
|---|---|
| neat emulsion/ore | 236 |
| emulsion/ore/urea (5%) | 293 |
| emulsion/ore/ZnO (1%) | 338 |
| emulsion/ore/ZnO (5%) | 353 |

Figure 3:
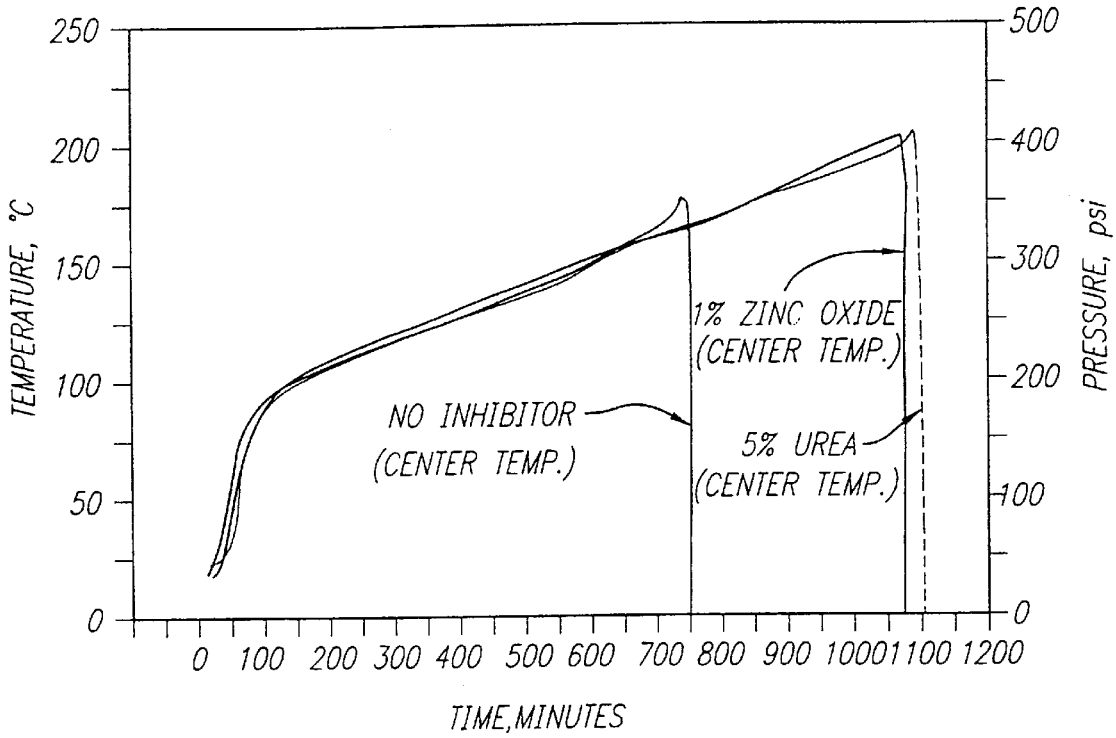
FIG. 3 is a graph illustrating data obtained from testing of emulsion explosives of the present invention and of the prior art.

Another set of time-to-explosion tests of 1 liter samples of neat emulsion explosive (with no inhibitor), emulsion explosive with 1% by weight zinc oxide powder, and emulsion explosive with 5% by weight urea, respectively, were preformed on ground up pyrite ore from a second sample. The graph of FIG. 3 shows the results, indicating the 1% by weight zinc oxide is approximately as effective urea as an emulsion explosive inhibitor.

Figure 4:
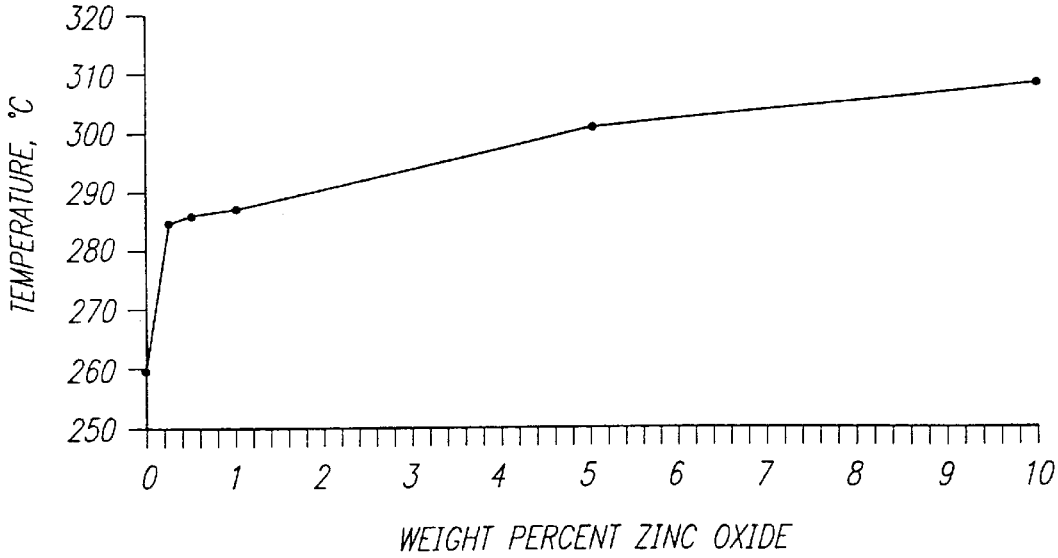
FIG. 4 is a graph illustrating the effectiveness of a range of zinc oxide concentrations as an inhibitor of the reactivity of ammonium nitrate with certain pyrite and sulfide ores.

FIG. 4 shows a graph of the critical temperature measured on ground up ore from the second sample in Henkin time-to-explosion tests for 0, 0.25%, 0.5%, 1%, 5% and 10% by weight zinc oxide powder, respectively, added as inhibitor to emulsion explosive according to the present invention. This graph shows that as little as 0.25% by weight zinc oxide powder is an effective inhibitor of premature denotation due to reactivity of ammonium nitrate with pyrite ore, at least for that typical sample. There is no reason to expect that higher percentages than the 10% shown in FIG. 4 would not also be effective, although use higher concentrations would be unnecessary and wasteful.

An additional set of 50 gram sample cook-off tests indicated a slight advantage in the effectiveness of 1% by weight zinc oxide inhibitor compared to use of 5% by weight urea as an inhibitor in emulsion explosives. Also, the results of the differential scanning calorimeter tests on 2 gram samples indicated 5% by weight urea was slightly more effective than 1% by weight zinc oxide powder as an inhibitor in emulsion explosive.

The conclusion of the independent testing organization was that emulsion explosive with 1 weight percent of zinc oxide powder was somewhat more effective overall than 5 percent urea inhibited emulsion explosive.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. A method of blasting in reactive ores containing sulfide and/or pyrite comprising the steps of:

(a) loading a borehole with an emulsion explosive including (1) an emulsifier, (2) a continuous organic fuel phase, (3) a discontinuous oxidizer salt solution phase including water and organic oxidizer salt, and (4) solid phase zinc oxide in an amount greater than about 0.25% of the weight of the composition; and (b) thereafter detonating the emulsion explosive.

2. The method of claim 1 wherein the solid phase zinc oxide is present in an amount from about 0.25% to about 10% of the weight of the composition.

3. The method of claim 1 wherein the solid phase zinc oxide is present in an amount from about 1% to about 5% of the weight of the composition.

4. A method of blasting in reactive ores containing sulfide and/or pyrite, comprising the steps of:

(a) diluting hot liquor of ammonium nitrate with water to provide diluted ammonium nitrate solution of predetermined concentration;

(b) adjusting the pH of the liquor of ammonium nitrate solution;

(c) adding a predetermined amount of gassing agent to the ammonium nitrate solution after step (b);

(d) adding a predetermined amount of fuel oil and emulsifier to the ammonium nitrate solution;

(e) emulsifying the ammonium nitrate solution after step (d);

(f) mixing the emulsified ammonium nitrate solution and fuel oil with an amount of zinc oxide powder in the range of about 0.5 to 10 weight percent to form an inhibited emulsion explosive;

(g) introducing the inhibited emulsion explosive into a borehole; and (h) thereafter detonating the inhibited emulsion explosive.

5. The method of claim 4 wherein the amount of zinc oxide powder is in the range of about 1 to 5 weight percent.

6. The method of claim 5 wherein the zinc oxide powder is less than about 325 mesh.

7. The method of claim 6 wherein the diluted ammonium nitrate solution is about 78.5% ammonium nitrate and 21.5% water.

8. The method of claim 7 wherein the pH of the ammonium nitrate solution is adjusted to be in the range from about 4.8 to about 5.2.

9. The method of claim 8 wherein step (e) includes emulsifying the ammonium nitrate solution by means of a high shear emulsifier.

10. The method of claim 9 wherein the gassing agent is sodium nitrite solution.

11. A method of blasting in reactive ores containing sulfide and/or pyrite, comprising the steps of:

(a) diluting hot liquor of ammonium nitrate with water to provide diluted ammonium nitrate solution of predetermined concentration;

(b) adjusting the pH of the liquor of ammonium nitrate solution;

(c) adding a predetermined amount of fuel oil and emulsifier to the ammonium nitrate solution;

(d) emulsifying the ammonium nitrate solution after step (c);

(e) mixing the emulsified ammonium nitrate solution with an amount of zinc oxide powder in the range of about 1 to 20 weight percent to form an inhibited emulsion explosive;

(f) mixing a predetermined amount of ANFO with the inhibited emulsion explosive to form inhibited heavy ANFO and introducing the heavy ANFO into a borehole; and (g) thereafter detonating the inhibited heavy ANFO.

12. The method of claim 11 wherein the zinc oxide powder is less than about 325 mesh.

13. The method of claim 12 wherein the diluted ammonium nitrate solution is about 78.5% ammonium nitrate and 21.5% water.

14. The method of claim 13 wherein step (d) includes emulsifying the ammonium nitrate solution by means of a high shear emulsifier.

15. The method of claim 14 wherein the mixing of step (f) is in the ratio of 24 weight percent emulsion explosive, 71 weight percent ammonium nitrate prills, and 5 weight percent fuel oil.

* * * * *